US005119622A

United States Patent [19]

Stahlecker

[11] Patent Number: 5,119,622

[45] Date of Patent: Jun. 9, 1992

[54] SPINNING MACHINE HAVING A PLURALITY OF DRAFTING UNITS AND A MOVABLE CLEANING DEVICE FOR STRIPPING DEVICES

[75] Inventor: Fritz Stahlecker, Bad Überkingen, Fed. Rep. of Germany

[73] Assignee: Hans Stahlecker, Fed. Rep. of Germany; a part interest

[21] Appl. No.: 567,644

[22] Filed: Aug. 15, 1990

[30] Foreign Application Priority Data

Sep. 12, 1989 [DE] Fed. Rep. of Germany ..... 3930366

[51] Int. Cl.[5] ..... D01H 11/00; D01H 5/60

[52] U.S. Cl. ..... 57/300; 57/304; 57/305; 57/315; 19/263; 19/265

[58] Field of Search ..... 57/300, 301, 304–306, 57/315; 19/263, 265

[56] References Cited

U.S. PATENT DOCUMENTS

| | | | |
|---|---|---|---|
| 2,164,443 | 7/1939 | Batchelder | 19/265 |
| 2,593,478 | 4/1952 | Newton | 19/262 |
| 2,644,988 | 7/1953 | Haythornthwaite et al. | 19/265 |
| 2,741,802 | 4/1956 | Preston | 19/265 |
| 3,287,768 | 11/1966 | Rakhorst | 19/263 |
| 3,408,698 | 11/1968 | Rosele et al. | 19/263 |
| 4,317,261 | 3/1982 | Adamson | 19/265 |
| 4,706,339 | 11/1987 | Eder | 19/265 |
| 4,922,705 | 5/1990 | Sakai et al. | 57/300 |

FOREIGN PATENT DOCUMENTS

| | | | |
|---|---|---|---|
| 148621 | 6/1981 | Fed. Rep. of Germany | 19/262 |
| 3824986 | 2/1989 | Fed. Rep. of Germany . | |
| 722817 | 11/1955 | United Kingdom | 19/139 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In the case of a spinning machine having a plurality of drafting units arranged next to one another which each comprise a stripping device, a cleaning device for the stripping devices is provided which can be moved along the spinning machine. The cleaning device, in each case, moves the stripping devices from an operating position into a cleaning position, in which the cleaning of the stripping device is carried out.

19 Claims, 3 Drawing Sheets

SPINNING MACHINE HAVING A PLURALITY OF DRAFTING UNITS AND A MOVABLE CLEANING DEVICE FOR STRIPPING DEVICES

BACKGROUND AND SUMMARY OF THE INVENTION

The invention relates to a spinning machine having a plurality of drafting units arranged next to one another which each comprise a stripping device, and having a cleaning device for the stripping devices which can be moved along the spinning machine.

It is known from German Patent Document DE-A 38 24 986 to assign a stripping roller to the two rear pressure rollers of a drafting unit comprising three pairs of rollers, this stripping roller resting on these two rear pressure rollers. These stripping rollers of the drafting units arranged next to one another are cleaned by means of a movable cleaning device which carries a fiber waste remover with it which takes over the fiber residues adhering to the individual stripping rollers. In this case, it is also known to stop the stripping roller during the cleaning operation by means of a detent device and to detach it by means of an actuating element when the cleaning device passes by so that the stripping roller, as a result of a frictional drive, is driven by the pressure rollers to perform a rotating movement. The stripping roller is cleaned during this rotating movement. Subsequently, the stripping roller is again locked into its stripping position.

It is an object of the invention to develop a spinning machine of the initially mentioned type such that a secure and thorough cleaning of the stripping device is carried out.

This object is achieved according to preferred embodiments of the invention in that the stripping devices are arranged so that they can each be moved from an operating position into a cleaning position, and in that the cleaning device is equipped with devices for changing the stripping devices from the operating position to the cleaning position. By means of this development, it is achieved that the stripping devices which are moved into the cleaning position can be cleaned thoroughly and reliably without the danger that fiber residues or other dirt particles are pressed into the surfaces of the stripping devices by means of the pressure rollers.

In a further development of the invention, it is provided that each stripping device is provided with at least two sets of stripping elements which alternatively can be moved into the operating position and into the cleaning position. This ensures that, also during the cleaning of one stripping element, a stripping operation continues to be carried out at the respective drafting unit.

In a further development of the invention, it is provided that the continuously moving cleaning device is provided with devices which move against the adjusting elements of the stripping devices for moving the stripping device from the operating position into the cleaning position. In this case, it is utilized that the driving movement of the cleaning device is used also for moving the stripping devices from the operating position into the cleaning position so that no additional controllable drives are required.

In a further development of the invention, it is provided that the adjusting elements and/or the devices for the change operation are arranged and/or constructed in such a manner that the stripping devices of the drafting units which follow one another, with a respective opposite driving direction of the cleaning device, can be changed from the operating position into the cleaning position. A development of this type is particularly advantageous when the pressure rollers of two respective adjacent drafting units are constructed in a known manner as so-called twin pressure rollers. For reasons of space, this type of a development is particularly advantageous if the stripping devices can be swivelled out of the area of the pressure rollers.

In a further development of the invention, it is provided that the cleaning device is equipped with devices for stopping at each of the drafting units. As a result, if required, for example in the case of a yarn breakage at a spinning point pertaining to the drafting unit, an intensified cleaning of the stripping device may be carried out. In this case it is provided in addition as an advantageous further development that the cleaning device is equipped with cleaning elements which, in the stopped condition, can be applied to elements of a drafting unit. In this case, additional points which are at risk with respect to dirt deposits, such as fiber fly or the like, can then be cleaned by means of the cleaning elements.

In a further development of the invention, it is provided that the devices for changing the stripping devices from the operating position and the cleaning apparatus or cleaning apparatuses of the cleaning device are held in holding devices which can be moved away from the are of the drafting units. Thus the circumstance is taken into account that, in the case of a disturbance at a spinning point, the pertaining drafting unit may be opened. The cleaning apparatuses of the cleaning device may escape in such a manner that they drive past this opened drafting unit.

In an advantageous embodiment of the invention, it is provided that the stripping elements of the stripping devices are constructed as brush strips extending over several pressure rollers of a drafting unit which can be moved into and out of the operating position and the cleaning position around a shaft extending in the drafting direction of the drafting units. This results in a simple construction which, however, permits an intensive cleaning.

In an advantageous further development of the invention, it is also provided that the cleaning device comprises a cleaning brush which can be rotated around a shaft extending in parallel with respect to the drafting direction of the drafting units, a suction device being preferably assigned t this cleaning brush.

Other objects, advantages and novel features of the present invention will become apparent from the following detailed description of the invention when considered in conjunction with the accompanying drawings.

DETAILED DESCRIPTION OF THE DRAWINGS

Figure 1:
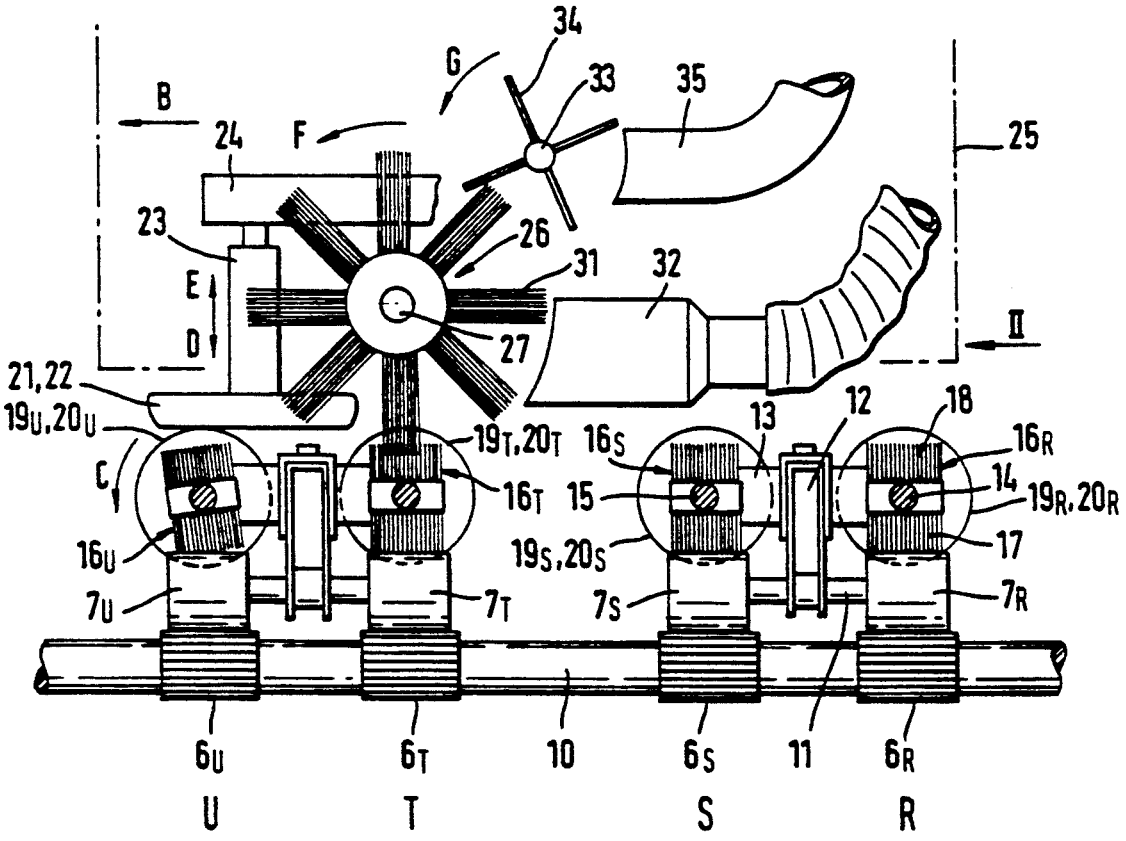
FIG. 1 is a schematic view in the drafting direction onto four drafting units with the pertaining stripping devices and a movable cleaning device, constructed according to a preferred embodiment of the invention.
Figure 2:
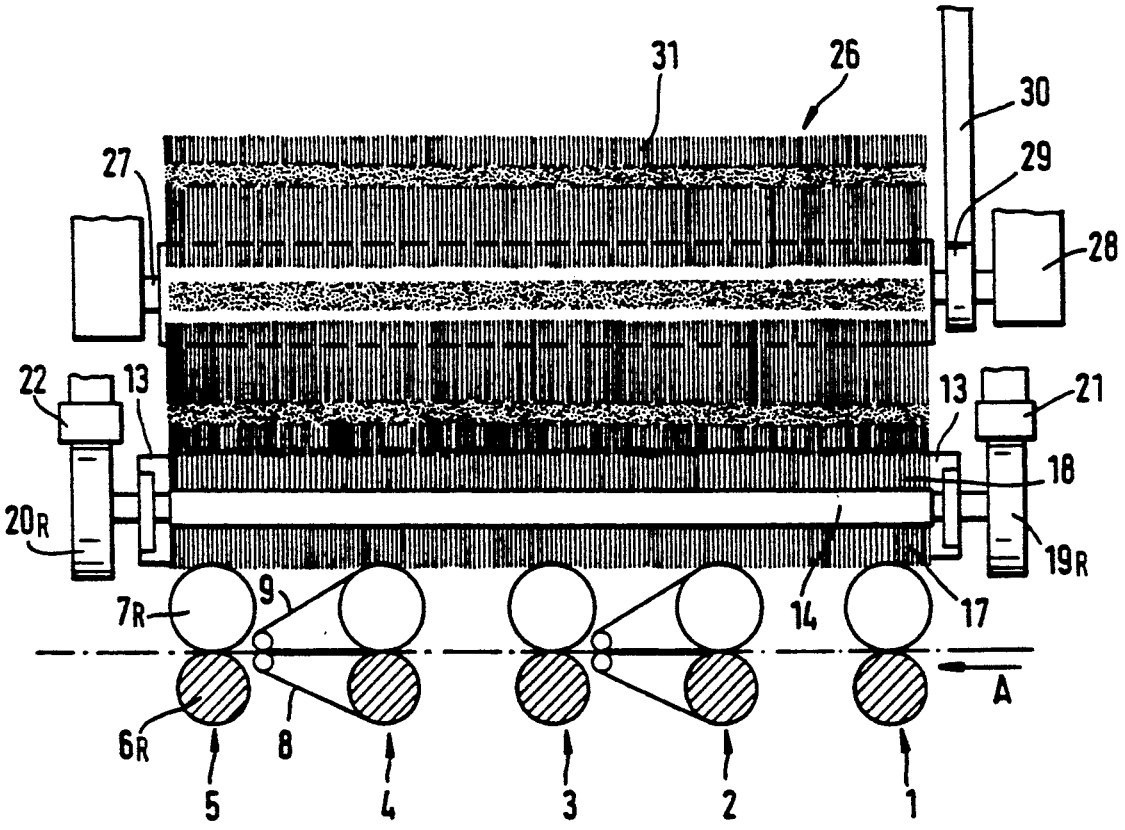
FIG. 2 is a view in the direction of the arrow II of FIG. 1 in which parts of the cleaning device were left out.

In the embodiment according to FIG. 1 and 2, the drafting units (R, S, T, and U) arranged next to one another in the longitudinal direction of the machine each have five pairs 1, 2, 3, 4, 5 of rollers through which slivers travel in the drafting direction (A). Each pair of rollers (1 to 5) has a drivable bottom roller 6R, 6S, 6T, 6U to which one pressure roller 7R, 7S, 7T, 7U respectively is assigned. In a known manner, guiding aprons 8, 8 wound also around roller pairs 2, 4 and, in each case, guide the sliver into the proximity of the nip line of the roller pair 3, 5 which follows.

The bottom rollers 6R, 6S, 6T, 6U are arranged on a common shaft 10 which extends through in the longitudinal direction of the machine and is drivable at the machine end. Two adjacent drafting units (R, S and T, U) respectively have pressure rollers (7R, 7S, and 7T, 7U) which are each provided with a common shaft 11 and thus are combined to so-called twin pressure rollers. In a known manner, these shafts 11 are guided in a load carrier 12 and are elastically pressed against the pertaining bottom rollers (6R, 6S, 6T, 6U).

Holders 13 are mounted at the load carriers 12 and carry the stripping devices (16R, 16S, 16T, 16U). These stripping devices each comprise swivel shafts 14, 15 which are disposed in the holders 13, extend above the pressure rollers (7R, 7S, 7T, 7U) and carry brush strips 17, 18 on sides which are opposite by 180°. These brush strips 17, 18 extend over the whole length of the drafting unit so that the bristles of these brush strips 17, 18 rest against all pressure rollers. One of the brush strips 17, 18 respectively is in the operating position, while the other is in a cleaning position in which it can be cleaned by a movable cleaning device 25 removing fiber residue or the like which has accumulated in the bristles. In this case, the cleaning device 25 is constructed such that, interacting with corresponding adjusting devices of the stripping device (16R, 16D, 16T, 16U), it changes the respective brush strip 17, 18 to be cleaned from the operating position into the cleaning position.

In the embodiment shown in FIGS. 1 and 2, the shafts 14, 15, at their two ends, are equipped with frictional wheels (19R, 20R; 19S, 20S; 19T, 20T; 19U, 20T against which the skids 21, 22 move of the movable cleaning device 25. The skids 21, 22 which are elastically loaded in the direction of the arrow (D) are designed such that they drive the respective frictional wheels, in the embodiment according to FIG. 1, frictional wheels 19U, 20U and turn them by 180° in such a manner that the brush strip 17 of the stripping element 16U, which had previously been in the stripping position, is moved into the cleaning position, and the brush strip 18 is moved into the stripping position.

The skids 21, 22 move ahead of a cleaning apparatus constructed as a rotating brush 26 in such a manner that, in each case, it meets a stripping device which has already been changed into the cleaning position; i.e., in the embodiment according to FIG. 1, the stripping device 16T. The cleaning device 25 is provided with a second pair of skids which is not shown in the drawing. With respect to the cleaning brush 26, this second pair of skids is located on the opposite side of skids 21, 22. If the moving direction of the cleaning device 25 is in the direction of the arrow (B), the skids 21, 22 were are then moving ahead will be used. When the moving direction of the cleaning device 25 is reversed, these skids are pulled in the direction of the arrow (E) while the skids which are not shown and will then move ahead against the direction of the arrow (B) are moved out.

The brush 26 is driven in the direction of the arrow (F) so that it can rotated around a shaft 27 extending in parallel with respect to the drafting direction (A). A suction device 32, which sucks off the fiber residues that were taken over and removes them to a waste receiver is assigned to its bristles 31. A combing device 34, which rotates around a shaft 33 in the direction of arrow (G), is also assigned to the bristles 31 and, by means of needle rakes or the like, combs out the bristles 31 and takes over adhering fiber residues or the like. An additional suction device 35 is assigned to this combing device 34.

By means of its shaft 27, the cleaning brush 26 is disposed in a holding device 28. A pulley 29, which is driven by a motor that is not shown by way of a belt 30, is disposed on the shaft 27. The holding device 28, just like the holding device 24 of the skids 21, 22, can be lifted in the direction of arrow (E), thus vertically, off the plane of the drafting direction by means of a lifting drive which is not shown. This is advantageous because, in the case of a disturbance at one of the spinning points assigned to the drafting units (R, S, T, U), the pertaining load carrier 12 is lifted off in order to interrupt the spinning operation. This lifting device is controlled by sensors which are not shown and which are mounted on each side, moving ahead with respect to the driving direction, on the cleaning device 25 and sense the vertical position of the load carriers 12. By means of these sensors, it may then also be provided that the cleaning device 25 stops at the drafting unit (R, S, T or U) at the respective spinning point and carries out a prolonged cleaning cycle. In this case, additional cleaning apparatuses may be assigned to the corresponding drafting unit, particularly combined blowing and suction devices which, for example, free the shafts 11 from fiber fly. In the same manner, the cleaning device 25 may then be equipped with so-called rolling pickers, i.e., rotating needles which are controlled by means of a program in such a manner that they clean one or several specific points of the drafting units.

In a modified embodiment of the invention, other adjusting elements are provided instead of the frictional wheels 19R, 20R; 19S, 20S; 19T, 20T; 19U, 20U), corresponding different driving elements of the cleaning device 25 being assigned to these adjusting elements. In particular, it will then be provided that a lever mechanism is assigned to the stripping devices 16R, 16S, 16T, 16U which, when a driving device of the cleaning device 25 starts, causes a rotation by 180° and which then locks the stripping devices 16R, 16S, 16T, 16U in the position which is offset by 180°.

In another modification of the embodiment according to FIG. 1, it provided that the drive of the cleaning brush 26 is changed over into the opposite rotating direction each time the driving direction of the cleaning device 25 is reversed. As a result, it may be achieved that (in contrast to the representation according to FIG. 1) the brushing movement of the cleaning brush 26 is reinforced by the driving movement.

In the embodiment according to FIG. 3, it is again provided that a stripping device 16R, 16S, 16T, 16U is assigned to each of the drafting units (R, S, T, U). These are cleaned by a movable cleaning device 25 in which case, however, certain stripping devices 16R, 16S, 16T, 16U are cleaned only in one driving direction of the cleaning device 25.

Figure 3:
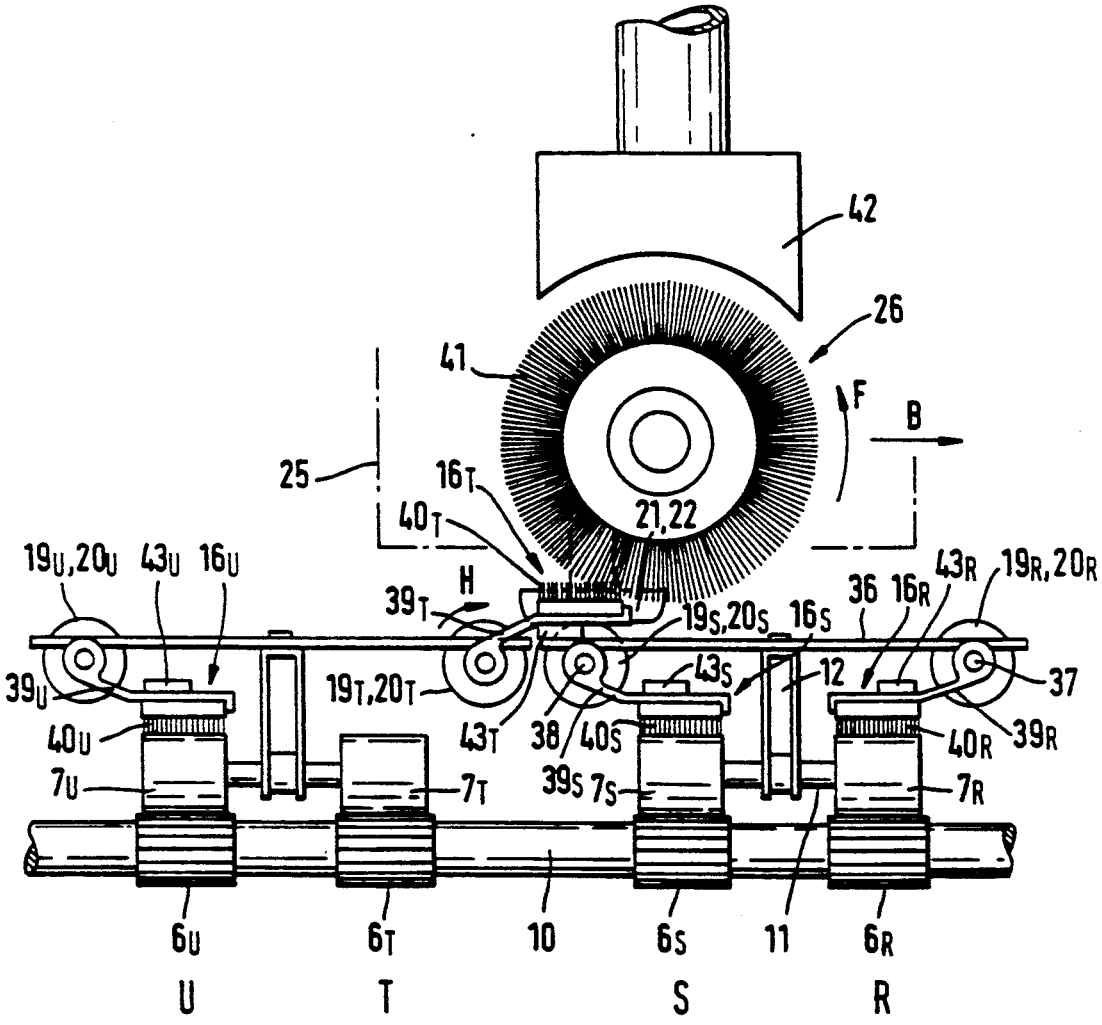
FIG. 3 is a view similar to that of FIG. 1 of another embodiment of the invention.

In the embodiment according to FIG. 3, holders 36 are mounted at the load carriers 12 which two drafting units (S, R and T, U) have in common, these holders 36 being able to be swivelled mirror-symmetrically from the operating position into the cleaning position (see stripping device 16T). At the holder 36, swivel shafts 37, 38 are arranged which, by means of lever arms 39R, 39S, 39T, 39U each carry one brush strip 40R, 40S, 40T, 40U. The lever arms 39R, 39S and 39T, 39U assigned to one load carrier 12 respectively are aligned mirror-symmetrically with respect to the pertaining load carrier 12. The respective successive brush strips 40R, 40S, 40T 40U can be swivelled in the opposite direction to one another from the operating position into the cleaning position.

The lever arm 39R, 39T which, in each case, is on the right in the drawing according to FIG. 3 can be swivelled open clockwise, and the lever arms 39S, 39U can be swivelled counterclockwise. The cleaning position is shown for drafting unit (T). The brush strip 40T is swivelled away such that its bristles point upwards. In this case, a stop 43T of the lever 39T places itself against the holder 36 so that the cleaning position is specified.

Also in the embodiment according to FIG. 3, the change into the cleaning position is caused by means of skids 21, 22 which move against frictional wheels 19R, 20R; 19S, 20S; 19T, 20T; 19U, 20U which are non-rotatably connected with the shafts 37, 38. The frictional wheels 19R, 20R; 19S, 20S of the respective successive shafts 37, 38 are arranged to be offset transversely to the moving direction of the cleaning device 25. During each reversal of the moving direction, the position of the skids 21, 22 is displaced transversely to the driving direction so that they will then, in each case, come in contact with the predetermined frictional wheels in order to transfer the stripping device into the cleaning position.

The movable cleaning device also comprises a rotating cleaning brush 26 to which a suction device 42 is assigned which sucks fiber residues or the like out of the bristles 41.

In the embodiment according to FIG. 3, it is provided that the skids 21, 22 take along frictional wheels 19R, 20R; 19T, 20T in one driving direction (driving direction B) of the cleaning device 25, and frictional wheels 19S, 20S; 19U, 20U in the other driving direction. The restoring movement of the stripping devices 16R, 16S, 16T 16U advantageously takes place by spring elements, particularly rotary springs, which are arranged in the area of the shafts 37, 38.

Although the invention has been described and illustrated in detail, it is to be clearly understood that the same is by way of illustration and example, and is not to be taken by way of limitation The spirit and scope of the present invention are to be limited only by the terms of the appended claims.

What is claimed is:

1. A spinning machine comprising:

a plurality of drafting units arranged next to one another for drafting respective different fiber slivers, a stripping device for each drafting unit, each stripping device being selectively movable between an operating position in stripping engagement with a respective drafting unit and a cleaning position out of engagement with the respective drafting unit, and a mobile cleaning device selectably movable between respective drafting units for cleaning the stripping devices at the respective drafting units, the cleaning device being equipped with transfer devices for transferring the stripping devices between respective operating and cleaning positions in response to movement of the mobile cleaning device to a position for cleaning the respective drafting unit, wherein said mobile cleaning device is movable along a travel path which is transverse to travel paths of sliver through the respective drafting units.

2. A spinning machine according to claim 1, wherein each stripping device is provided with at least two sets of stripping elements which can alternately be brought into an operating position and a cleaning position.

3. A spinning machine according to claim 2, wherein the cleaning device is a continuously moving cleaning device, said transfer devices being configured to move against adjusting devices of the stripping devices for moving the stripping devices from the operating position into the cleaning position.

4. A spinning machine according to claim 3, wherein at least one of the adjusting devices and the transfer devices are configured such that the stripping devices of the respective successive drafting units are transferred from the operating position into the cleaning position when the driving direction of the cleaning device is reversed.

5. A spinning machine according to claim 4, wherein the cleaning device is equipped with devices for stopping at each of the drafting units.

6. A spinning machine according to claim 5, wherein the cleaning device is equipped with cleaning elements which, in the stopped condition of the cleaning device, can be applied to elements of a drafting unit.

7. A spinning machine according to claim 6, wherein the transfer devices and cleaning apparatus of the cleaning device are held in holding devices which can be moved away from the area of the drafting units.

8. A spinning machine according to claim 7, wherein stripping elements of the stripping devices are constructed as brush strips extending over several pressure rollers of a respective drafting unit, these brush strips being movable into and out of the operating position and cleaning position around a shaft extending in parallel to the drafting direction of the drafting units.

9. A spinning machine according to claim 3, wherein the transfer devices are held in holding devices which can be selectively moved away from the area of the drafting units.

10. A spinning machine according to claim 1, wherein the cleaning device is equipped with devices for stopping at each of the drafting units.

11. A spinning machine according to claim 1, wherein the cleaning device is equipped with cleaning elements which, in the stopped condition of the cleaning device, can be applied to a respective drafting unit.

12. A spinning machine according to claim 1, wherein the stripping elements of the stripping devices are constructed as brush strips extending over several pressure rollers of a drafting unit, these brush strips being movable into and out of the operating position and cleaning position around a shaft extending in parallel to the drafting direction of the drafting units.

13. A spinning machine according to claim 1, wherein the cleaning device comprises a cleaning brush which can be rotated around a shaft extending in parallel to the drafting direction of the drafting units, a suction device being assigned to the cleaning brush.

14. A spinning machine according to claim 13, wherein the cleaning device is equipped with devices for stopping at each of the drafting units.

15. A spinning machine according to claim 1, wherein said cleaning device includes a cleaning brush which is dimensioned and configured to extend over a plurality of drafting roller sets of a respective drafting unit.

16. A spinning machine according to claim 1, wherein each of said drafting units includes a plurality of drafting roller sets disposed downstream of one another along a path of sliver being drafted.

17. A spinning machine according to claim 16, wherein each of said stripping devices includes a stripping brush which is selectively strippingly engageable with rollers of said drafting roller sets.

18. A spinning machine according to claim 17, wherein said cleaning device includes a cleaning brush which is engageable with said stripping brushes during cleaning operations.

19. A spinning machine according to claim 18, wherein said drafting roller sets include respective holders holding respective paris of pressure rollers of the drafting roller sets, said stripping devices including separate stripping brushes for each of the pressure rollers of respective ones of said pairs.

* * * * *